US008784943B2

(12) United States Patent
Benson et al.

(10) Patent No.: US 8,784,943 B2
(45) Date of Patent: Jul. 22, 2014

(54) PROCESS FOR GUNITING REFRACTORY MIXES USING CONVENTIONAL DRY GUNNING EQUIPMENT AND REFRACTORY MIXES FOR USE IN SAME

(75) Inventors: James Benson, Warrier, AL (US); Robert Pattillo, Birmingham, AL (US); Heidi Zinn, McArthur, OH (US)

(73) Assignee: Reno Refractories, Inc., Morris, AL (US)

( * ) Notice: Subject to any disclaimer, the term of this patent is extended or adjusted under 35 U.S.C. 154(b) by 226 days.

(21) Appl. No.: 13/120,130

(22) PCT Filed: Mar. 11, 2010

(86) PCT No.: PCT/US2010/026972

§ 371 (c)(1),
(2), (4) Date: Mar. 21, 2011

(87) PCT Pub. No.: WO2010/105049

PCT Pub. Date: Sep. 16, 2010

(65) Prior Publication Data

US 2011/0223341 A1 Sep. 15, 2011

Related U.S. Application Data

(60) Provisional application No. 61/159,183, filed on Mar. 11, 2009.

(51) Int. Cl.

| | |
|---|---|
| ***B05D 1/34*** | (2006.01) |
| ***B28C 5/02*** | (2006.01) |
| ***B28C 5/06*** | (2006.01) |
| ***F27D 1/16*** | (2006.01) |

(52) U.S. Cl.

CPC . *B28C 5/026* (2013.01); *B28C 5/06* (2013.01); *B04F 21/12* (2013.01); *F27D 1/1642* (2013.01)

USPC ..... 427/426; 427/427; 427/397.7; 427/421.1

(58) Field of Classification Search

USPC ..... 427/426, 427, 397.7, 421.1

See application file for complete search history.

(56) References Cited

U.S. PATENT DOCUMENTS 4,239,397 A 12/1980 Sandell et al.
4,326,560 A * 4/1982 Drudy ..... 137/897

(Continued)

FOREIGN PATENT DOCUMENTS

EP 0307066 A2 3/1989
EP 0506421 A1 9/1992

(Continued)

OTHER PUBLICATIONS

Korean Intellectual Property Office, International Search Report and Written Opinion of related PCT Application No. PCT/US2010/026972 dated Oct. 27, 2010.

*Primary Examiner* — Timothy Meeks
*Assistant Examiner* — Nathan T Leong
(74) *Attorney, Agent, or Firm* — Patzik, Frank & Samotny Ltd.

(57) ABSTRACT

A dry refractory mix and a method for apply the dry refractory mix to a surface. One aspect of the invention utilizes gunning mixes without cement. The dry refractory mix also may include a setting agent that is homogeneously blended with the refractory mix. In operation, when used with pneumatic systems, dry refractory material is fed into a hopper of a gunnite machine, introduced into an air flow, and conveyed by air through one or more hoses to a nozzle. A liquid binder is introduced into the air flow for mixing with the suspended dry refractory material at or before the nozzle. A fitting, such as a water ring with holes, may be used for injecting the binder into the air flow containing the dry refractory material. The mixed refractory/binder material is discharged through the nozzle for application to a surface.

22 Claims, 8 Drawing Sheets

(56) References Cited

U.S. PATENT DOCUMENTS

| | | | | |
|---|---|---|---|---|
| 4,804,563 | A * | 2/1989 | Hillemeier et al. | 427/397.7 |
| 5,147,834 | A * | 9/1992 | Banerjee | 501/129 |
| 5,549,745 | A | 8/1996 | Langenohl et al. | |
| 5,961,712 | A | 10/1999 | Sun et al. | |
| 2004/0144859 | A1 | 7/2004 | Gist et al. | |
| 2005/0095367 | A1 * | 5/2005 | Babiarz et al. | 427/421.1 |
| 2008/0314084 | A1 | 12/2008 | Connors et al. | |

FOREIGN PATENT DOCUMENTS

| | | | |
|---|---|---|---|
| WO | 96/01700 | A1 | 1/1996 |
| WO | WO2005098333 | * | 10/2005 |

* cited by examiner

PROCESS FOR GUNITING REFRACTORY MIXES USING CONVENTIONAL DRY GUNNING EQUIPMENT AND REFRACTORY MIXES FOR USE IN SAME

This invention claims benefit to U.S. Provisional Patent Application Ser. No. 60/159,183, filed Mar. 11, 2009, the entirety of which is hereby incorporated by reference.

FIELD OF THE INVENTION

The invention relates to a process for guniting refractory mixes using dry gunning equipment using a modified binder system, as well as to the refractory mixes for use in such a process.

BACKGROUND OF THE INVENTION

Refractory materials are designed to retain their strength at high temperatures and are thus used, for among other things, as liners in furnaces, incinerators and ovens. The refractory materials may be applied in a number of known ways including by casting, pumping, shotcreting or dry gunning.

Although casting is suitable for creating liners in many applications, it requires significant time and expense in creating and using forms for the casting. Furthermore, it is not always feasible to build forms depending on the shape of the casting and or its application.

Pumping a wet castable through a hose also has problems. Among other things, pumping a wet material through equipment can often to lead to plugged lines. For example, variations in the raw materials and/or conditions at the job site can lead to a marginally pumpable material that can cause plugging and setting of the material in the hoses, thus shutting down the job. Additionally, pumping requires the use of expensive equipment.

While shotcreting, which involves pneumatically projecting mortar or concrete onto a surface at a high velocity, may work, it requires the use of expensive equipment and a large work crew to operate. Shotcreting introduces a setting agent at the nozzle, where it is not evenly distributed throughout the refractory mass, thereby leading to variations in material properties. In order for shotcreting to be used with colloidal silica bonded materials, it is generally necessary to use 9-10% colloidal silica, thereby resulting in 6% to 6.6% water in the finished product. To prevent the castable from slumping on the wall, a water-containing setting agent is injected at the nozzle to cause the mass to harden upon being applied to the surface.

In addition to the problems set forth above, the increased level of water required in the pumping and shotcreting methods in order to achieve a fluid consistency results in a higher porosity product. This results in decreased properties and resistance to slag and metal penetration. Additionally, the high percentage of water also increases the drying time for these methods.

Current dry gun methods include the introduction of water into a nozzle. The nozzle being attached to the end of a hose used to transport the dry material in a compressed air stream. However, problems have arisen using this process from, among other things, the introduction of water. In particular, it is important to make sure that the cement is properly hydrated so a large amount of water is necessary to be introduced at the nozzle. The use of a large amount of water weakens the compressive strength of the finished product. Additionally, it is very difficult to wet the fine components of the material in the very short residence time within the nozzle. The poor mixing between the fine powders, coarse aggregates and water in the nozzle results in some portion of the material bouncing off the surface or rebounding. This creates clean up, occupational hazards, and waste as well as increasing the cost of application while decreasing the processes efficiency. Dry gunniting also creates a significant amount of dust that can be hazardous to operators of the machines.

SUMMARY OF THE INVENTION

The present invention is an improvement over the prior art dry gunniting systems and methods, in one embodiment, in that the design of the dry mix and the application method allow the installation of refractory with properties that surpass regular gunnite mixes and shotcrete products. One aspect of the invention utilizes gunning mixes that do not contain cement. The dry refractory mix also may include a setting agent that is homogeneously blended with the other materials.

In operation, when used with pneumatic systems, dry refractory material material is fed into a hopper of a gunnite machine and is then introduced into an air flow and conveyed by air through one or more hoses to a nozzle. A liquid binder is introduced into the air flow for mixing with the suspended dry refractory material at or before the nozzle. A fitting, such as a water ring with holes, may be used for injecting the binder into the air flow containing the dry refractory material. A pump or other know pressurizing means is used to pressurize the binder and force it flow to the fitting. A needle valve may be used to control the amount of liquid binder introduced into the system. The dry refractory material is discharged through the nozzle for application to the surface with the liquid binder.

It is therefore an object of the present invention to provide a new and improved process for applying refractory mixes.

Another object of the present invention is to provide a new and improved process for applying refractory mixes that limits the amount of water needed.

Yet another object of the present invention is to eliminate the need to use a cement in a dry gunning application.

It is yet another object of the present invention to produce a system for applying refractory mixes that is economical and easy to use.

Still another object of the invention is to provide refractory mixes having increased physical properties.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
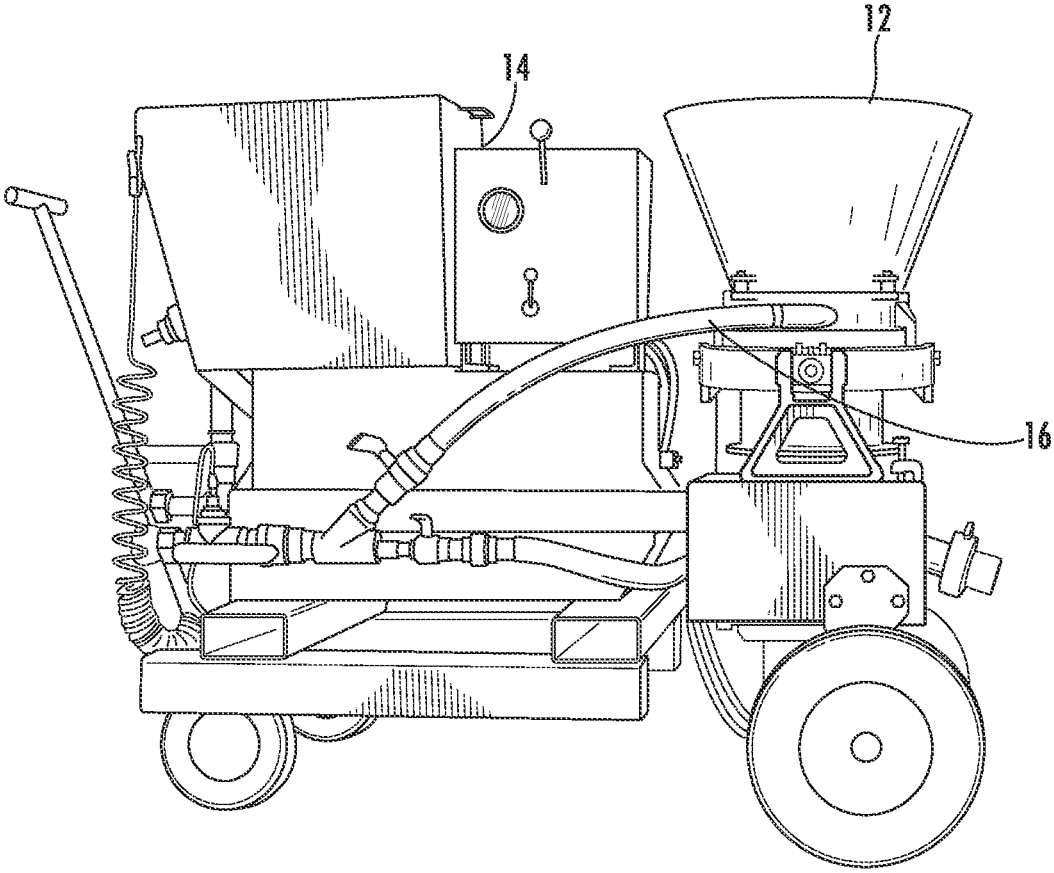
FIG. 1 (PRIOR ART)
FIG. 1 is a front perspective view of one embodiment of a dry gunning machine.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

One aspect of the present invention is directed to a line of no-cement gunning mixes that can be applied using conventional guniting equipment such as Allentown and Blastcrete pneumatic guns. The dry mix, which is provided into a storage area for the guniting equipment, is conveyed by air though hoses and the binder is added at the nozzle or application end of the hose. The design of these mixes and the application method allow the installation of refractory with properties that surpass regular gunite mixes and shotcrete products. The binder and the mix design result in installed product with excellent thermal shock resistance, high hot load strength, lower porosity and excellent resistance to chemical attack. Examples of no-cement gunning mixes include, but are not limited to, materials comprising 0-95 percent aluminum oxide, 0-95 percent alumino-silicate compounds, 0-100 percent zircon, 0-95 percent Alumina-Zirconia-Silicate (AZS), 0-100 percent Silica, 0-90 percent silicon carbide, or 0-80 percent chrome oxide with the remaining balance being alumina. The formulations designed for use in this invention are similar to those normally used for application with a Shotcrete or gunnite installation. The preferred modification is that the amount of fine powders in the formulation are reduced by approximately 5% since the binder is added to the material in the nozzle. In a preferred embodiment, the dry refractory mix includes a setting agent that is homogeneously blended with the other materials.

Referring to FIG. 1, one embodiment of a known gunite machine 10 to apply the refractory mixes is shown. While a number of gunite machines may be utilized, it is appreciated that good results will occur through use of a pneumatic gunite machine such as an Allentown or Blastcrete gun (as shown in FIG. 1). The gunnite machine include a hopper 12 for receiving a refractory material, and a pump 14 for generating an air flow through hose 16. A valve 18 on the connector for the hose 16 can regulate the flow of materials and air through the hose 16. A coupling member 20 at the end of the connector permits a hose 30 to be attached or connected thereto in a known way. An air compressor, capable of maintaining a minimum pressure of 80 psi at the gun and an air flow of at least 450 cfm is also recommended. Material can be feed into the hopper 12 in a variety of ways, including but not limited to, by individual small bags, bulk bags with flow control spouts or surge hoppers placed above the hopper.

Figure 2:
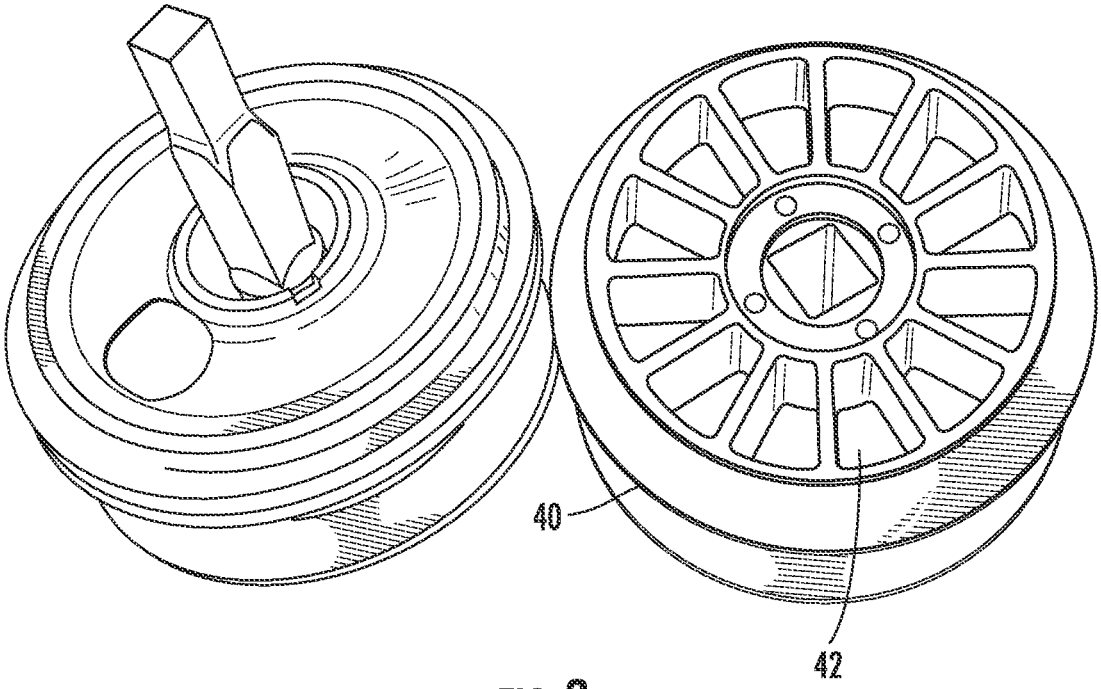
FIG. 2 (PRIOR ART)
FIG. 2 is a top perspective view of a half section or half height bowl and spacer.
Figure 3:
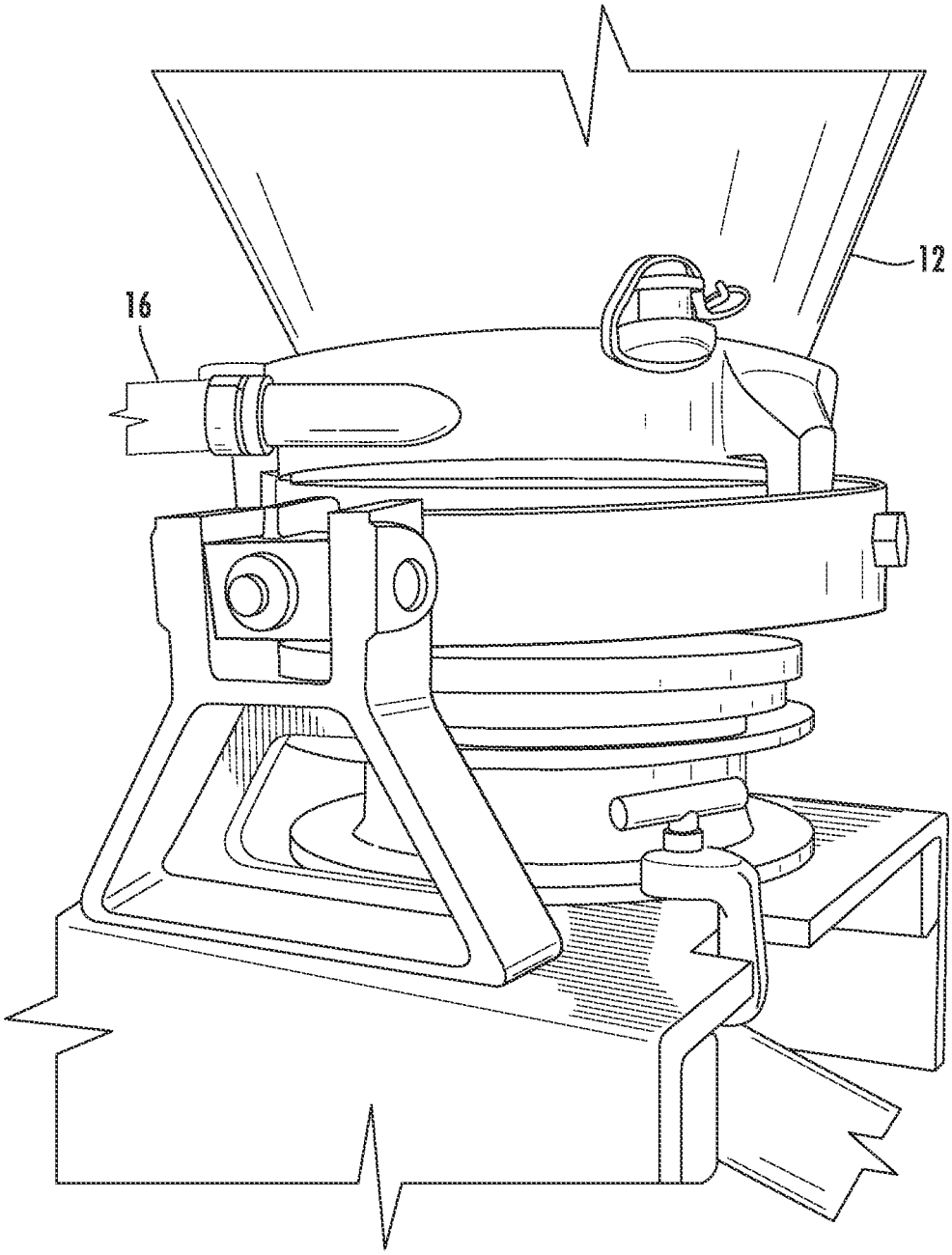
FIG. 3 (PRIOR ART)
FIG. 3 is a partial perspective view of a dry gunning machine of FIG. 1 showing a half height bowl.

In one embodiment using a pneumatic gunite machine, it is appreciated that the feed rate and mechanism needs to be reduced from what is generally supplied by the gun manufacturer. Normally the gun is set up for high production, high volume gunning of high cement gun mixes. The nature of the refractory gunnite mixes in this invention requires intimate mixing of the binder with the dry powder to achieve superior results. Blastcrete has what is referred to a "half sector bowl". The openings in the feed wheel are the same but the height of the bowl is one half of the high production bowl. As shown in FIGS. 2 and 3, the half sector bowl 40 defines a plurality of open spaces 42 that allows a more even flow of material into the air stream or air flow and somewhat reduces the amount of material in the hose 16. This allows smoother gunning and complete wetting of the material by the liquid at the nozzle.

The liquid binder provided for the refractory mixes may be supplied in large tote tanks or if desired, in five gallon pails. The binder is preferably introduced into the dry material at or proximate the nozzle. A diaphragm pump can be use to pump the binder to the "water ring" 50 between the hose 30 and the nozzle 60. It is also appreciated that other known devices and systems for moving liquids under pressure may be utilized including, but not limited to, other types of pumps and pressurized tanks The "water ring" 50 is a circular tube arrangement with multiple fine holes 52 drilled into the inner surface. In the preferred embodiment, an 8 hole ring is used. The binder is delivered through the binder line 70 using a series of high pressure jets into the passing material at the ring 50. A needle valve 72 may be used to precisely control the amount of liquid binder introduced into the ring 50 through tubing or connector 74. Too much binder will result in slumping and too little will cause excessive dusting and rebound. It is appreciated that amount of pressure needed will vary depending on the needed flow rate and addition rate, as well as the type of ring or fitting used. In one embodiment, the binder pump should supply the binder to the high pressure jets with a minimum of 100 psi to increase the wetting efficiency, reduces the amount of binder used, reduce dusting and rebound and maximize the physical properties of the material. In another embodiment, the binder may be discharged under a minimum of 20 psi differential pressure to the material transport hose. In all cases, the binder should be delivered at a pressure sufficient for injection into the air stream transporting the suspended dry refractory aggregates.

While a variety of liquid binders may be used, examples of liquid binders includes, but are not limited to, sodium silicate, potassium silicate, a resin (nouvalac, phenolic, aqueous and non aqueous polymers) or a binder that includes colloidal silica or other dispersed colloidal particles. The binder does not necessarily need to contain water, only that it is a liquid that can be pumped and injected into the air stream containing the dry refractory particles. or a binder that includes a colloidal silica or dispersed colloidal particles. One example of a binder includes a colloidal silica solution composed of colloidal silica particles dispersed in water at a 10-50% concentration level. In another embodiment, a portion of the fine particles of the refractory is predispersed in the colloidal silica liquid.

In another example, the process of the present invention injects about 4% to 30% colloidal silica into the dry refractory material. Where 9.0 to 11.0% colloidal silica is injected into the dry material, this equals an addition of 5.4-6.6% water from the binder solution. This amount of water addition represents a significant reduction of water in the finished materials from prior gunnite processes. Less water results in a lower porosity product, which provides improved properties and resistance to slag and metal penetration. It is appreciated that the amount of colloidal silica used can vary depending upon the particular dry material used.

Figure 4:
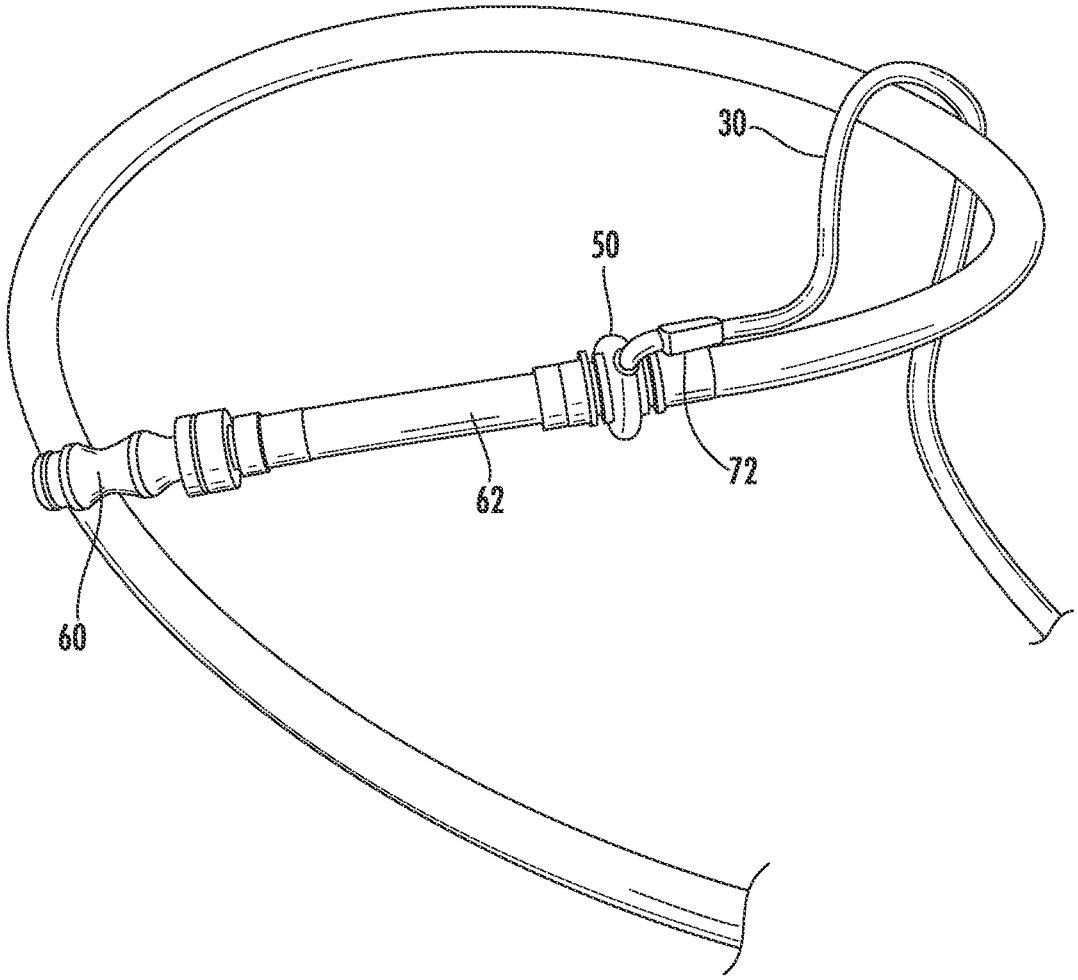
FIG. 4 is a front perspective view of one embodiment of a nozzle showing a nozzle extension.
Figure 5:
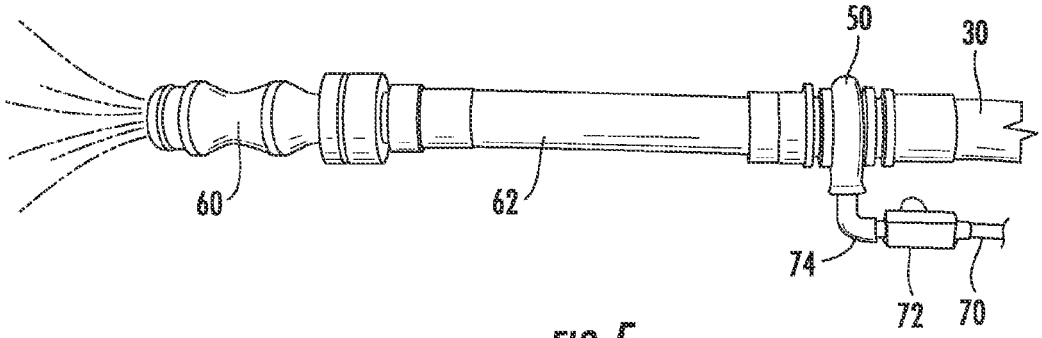
FIG. 5 is a front elevation view of the nozzle and nozzle extension of FIG. 4.

A nozzle extension 62 and double bubble nozzle 60 may be used to allow improved mixing of the liquid and the dry material before exiting the nozzle 60. One example is shown in FIGS. 4 and 5. In one embodiment, this extension 62 can be 12 to 24 inches long. For comfort, the needle valve control can be mounted next to the nozzle while the liquid is introduced back 12-24 inches from the nozzle.

Figure 6:
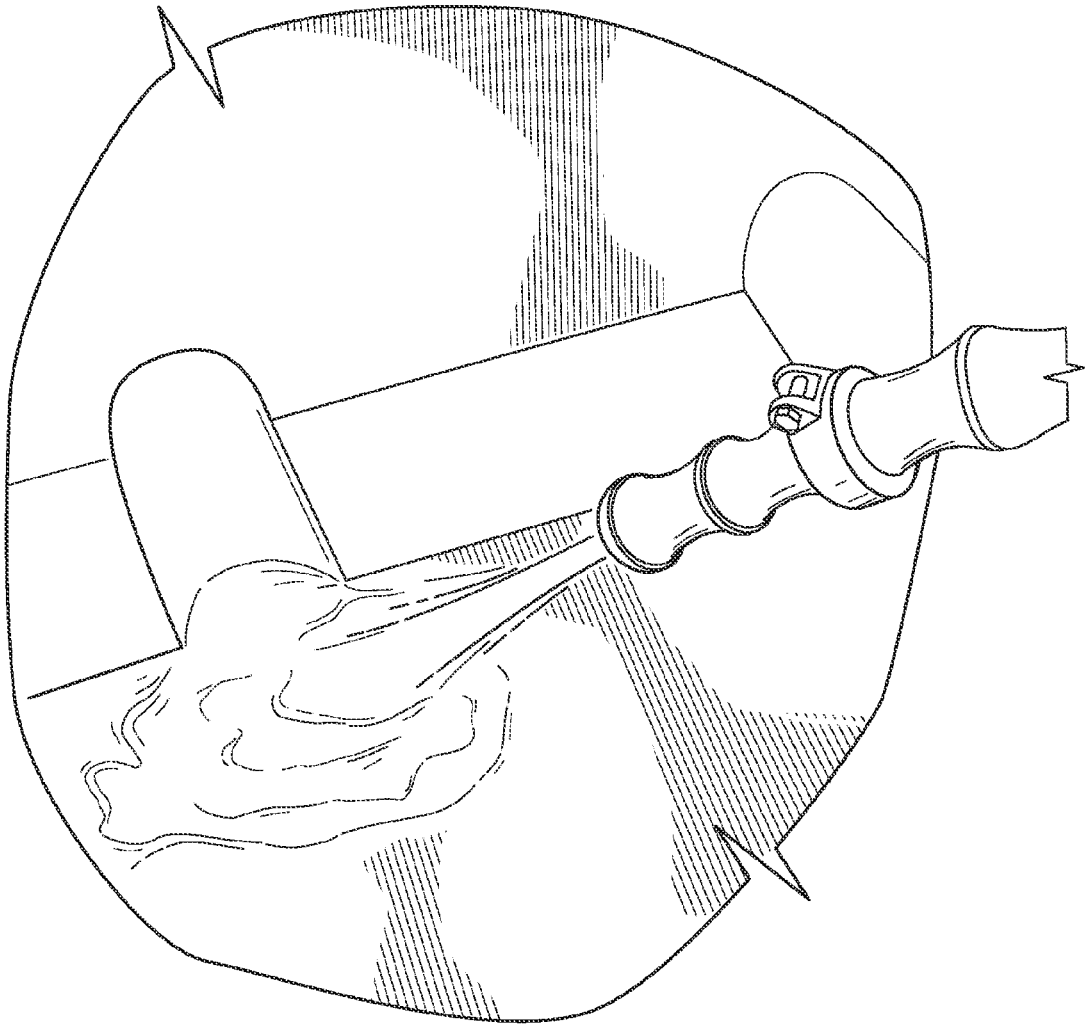
FIGS. 6 and 7 are perspective views illustrating the application of material to a surface through a nozzle.
Figure 7:
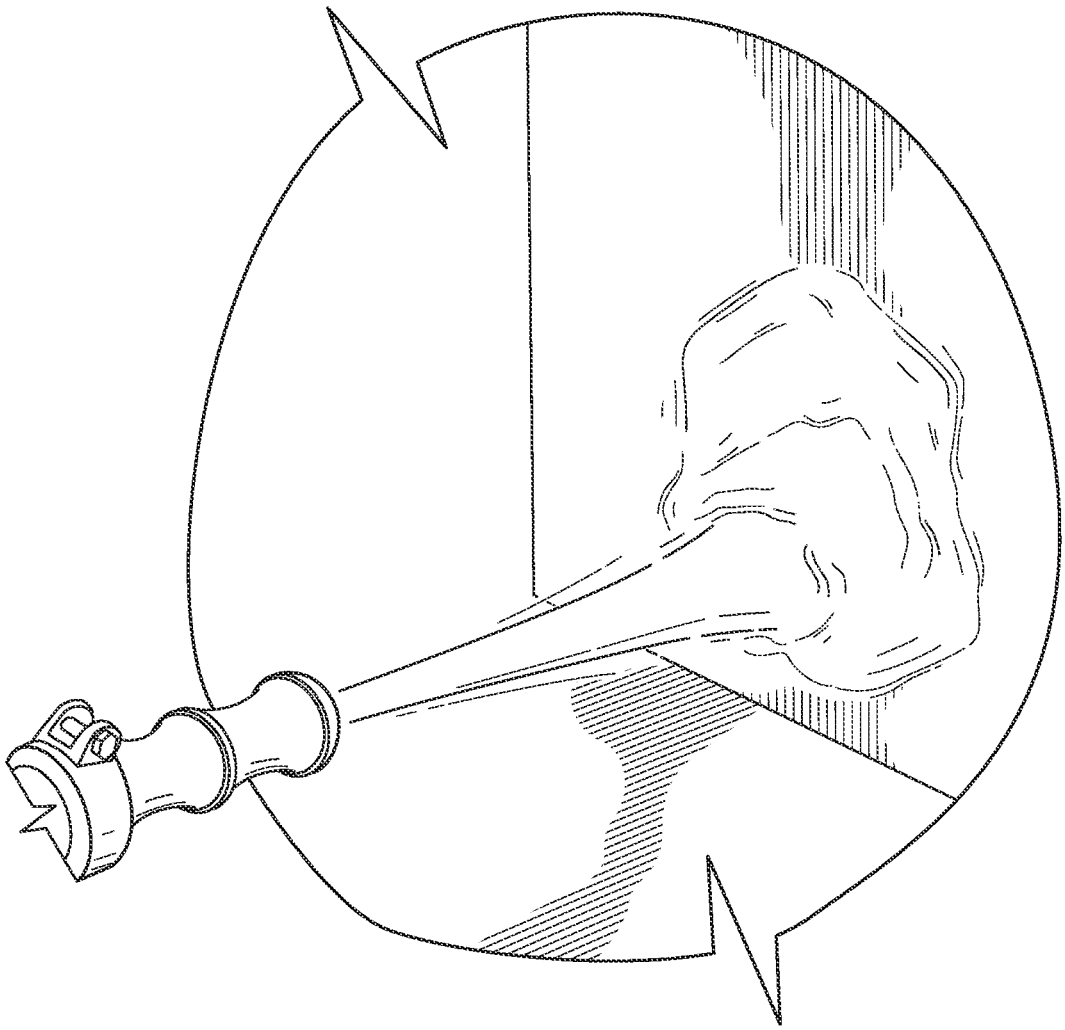
Figure 8:
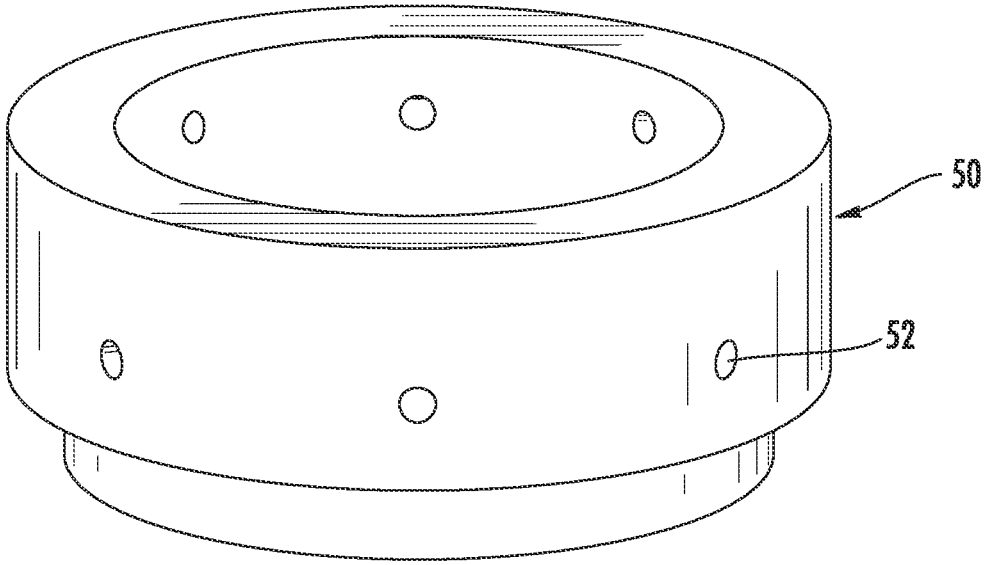
FIG. 8 (PRIOR ART)
FIG. 8 is a front perspective view of a water ring.

Referring to FIG. 6, one option for use with the nozzle extension is to use two double bubble nozzles fitted together in series. The binder and dry material mix very well using this arrangement. Some installers find the double bubble nozzle arrangement easier to use as compared to an extension.

The use of the nozzle extension or double bubble nozzle, an 8 hole water ring and pressurized binder delivery system will provide adequate wetting of the refractory before it exits the nozzle.

It will be understood that modifications and variations may be effected without departing from the scope of the novel concepts of the present invention, but it is understood that this application is limited only by the scope of the appended claims.

The invention claimed is:

1. A process for applying dry refractory mixes to a surface using a gunite machine having a nozzle, comprising the steps of:

providing dry refractory material containing a setting agent into a storage area for the gunite machine;

introducing the dry refractory material into an air flow generated within the gunite machine;

subsequent to the step of introducing the dry refractory material into the air flow, introducing a liquid binder into the air flow generated within the gunite machine, wherein the liquid binder is mixed with the dry refractory material to form a mixture at or proximate the nozzle; and discharging the mixture through the nozzle for application to the surface to be coated with the refractory mix.

2. The process of claim 1 wherein the setting agent is homogeneously blended into the dry refractory material.

3. The process of claim 1 wherein the step of introducing a liquid binder includes the step of providing a fitting for injection of the binder into the air flow containing the dry refractory material.

4. The process of claim 3 wherein the fitting is a water ring with holes sized for compatibility with the liquid binder used.

5. The process of claim 3 which further comprises a plurality of high pressure jets operatively associated with the fitting to discharge the liquid binder under pressure.

6. The process of claim 3 which further comprises a needle valve to control the amount of liquid binder.

7. The process of claim 1 wherein the step of introducing a liquid binder includes the step of providing a fitting based on a water ring for injection of the binder into the air stream containing the dry refractory material.

8. The process of claim 1 wherein the step of introducing a liquid binder includes the step of injection of the binder into the air flow containing the dry refractory material at a location before the nozzle.

9. The process of claim 1 which further comprises a pump that pressurizes the binder.

10. The process of claim 1 which further comprises means to pressurize the binder.

11. The process of claim 1 wherein the liquid binder is discharged under a minimum of 20 psi differential pressure to the material transport hose.

12. The process of claim 1 which further comprises a nozzle extension.

13. The process of claim 1 wherein the nozzle is a double bubble nozzle.

14. The process of claim 1 wherein the liquid binder includes colloidal silica.

15. The process of claim 1 wherein the liquid binder is sodium silicate.

16. The process of claim 1 wherein the liquid binder is potassium silicate.

17. The process of claim 1 wherein the liquid binder is a nouvalac resin.

18. The process of claim 1 wherein the liquid binder is a phenolic resin.

19. The process of claim 1 wherein the liquid binder is a phosphate solution.

20. The process of claim 1 wherein the liquid binder is an aqueous polymer.

21. The process of claim 1 wherein the liquid binder is a non aqueous polymer.

22. The process of claim 1 wherein the liquid binder is composed of dispersed colloidal particles.

* * * * *